United States Patent [19]

Tarragona Corbella

[11] 4,229,030

[45] Oct. 21, 1980

[54] SAFETY DOOR FASTENING

[76] Inventor: Francisco J. Tarragona Corbella, Urgell 143, Barcelona, Spain

[21] Appl. No.: 5,086

[22] Filed: Jan. 22, 1979

[30] Foreign Application Priority Data

Jan. 31, 1978 [ES] Spain ..... 467.065

[51] Int. Cl.[3] ..... E05C 17/24

[52] U.S. Cl. ..... 292/270

[58] Field of Search ..... 292/268, 269, 270, 265, 292/267; 70/93

[56] References Cited

U.S. PATENT DOCUMENTS

| | | | |
|---|---|---|---|
| 355,419 | 1/1887 | Sprado | 292/268 |
| 372,326 | 11/1887 | Palmenberg | 292/268 |
| 1,497,500 | 6/1924 | Gorowitz | 292/268 |

FOREIGN PATENT DOCUMENTS

| | | | |
|---|---|---|---|
| 712102 | 7/1931 | France | 292/268 |

*Primary Examiner*—Richard E. Moore

*Attorney, Agent, or Firm*—Staas and Halsey

[57] ABSTRACT

A safety door fastening is disclosed, comprising a rigid retaining member pivotably attached to the door frame and a catch member attached to the door and having a terminal member adapted for sliding in a longitudinal space in the retaining member, to retain the latter and limit the angle of opening of the door, the retaining member having resilient means biasing it against the inner face of the door. It is possible to operate the catch member from the outside to disengage it from the retaining member.

7 Claims, 7 Drawing Figures

SAFETY DOOR FASTENING

BACKGROUND OF THE INVENTION

1. Field of the Invention

The present invention relates to a safety door fastening, of the type for limiting the angle of opening of a door and comprising on the one hand a rigid retaining member defining a longitudinal space and being pivotably attached to a vertical pin located on the door frame and on the other hand a catch member, mounted to the door, comprising an arm having a terminal member adapted to slide in the longitudinal space of the retaining member and hold it.

2. Description of the Prior Art

Hitherto known door fastenings for limiting the angle of opening of a door are only operative if, each time that the door is to be opened to attend to a caller, the retaining member mounted to the door frame is applied to the door, something which, either for forgetfulness or excess trust, is frequently not done, whereby the protection sought by having the safety fastening is not obtained.

Moreover, the hitherto known door fastenings of the type described are not made to be operated from the outside.

SUMMARY OF THE INVENTION

It is an object of the invention to provide a door fastening of the type described hereinbefore which will automatically, without having to be consciously applied by the user, be maintained in the operative safety position, thereby limiting the angle of opening of the door, and to provide means allowing the aforesaid means to be momentarily overridden from the outside of the door so that the user may cross through the door from the outside, without excluding the fact that such automatic means may be released from the inside to allow the door to be crossed from the inside, the fastening returning, in all cases automatically to its safety position when the door is reclosed.

The problem is solved according to the invention by a safety fastening characterised fundamentally in that the arm of the catch member is adapted for pivoting around a horizontal axis by operation of a lock means operable from the outside of the door, the retaining means having resilient means biasing it against the inner face of the door when the door is in the closed position thereof and said retaining member also having means which, in the closed position of the door, allows the arm of the catch member to be pivoted until its terminal member is disengaged from the longitudinal space of the retaining member.

The invention is also characterised in that the catch member also has a stop member limiting the pivoting movement of the arm in a downwards direction.

A further feature of the invention is that the catch member arm is fixedly attached to the cylinder of a lock means, said cylinder constituting the pivot shaft of the arm.

BRIEF DESCRIPTION OF THE DRAWING

Other objects and features of the invention will be disclosed in detail in the following description, with reference to the illustrative drawings in which.

DETAILED DESCRIPTION OF THE PREFERRED EMBODIMENTS

Figure 1:
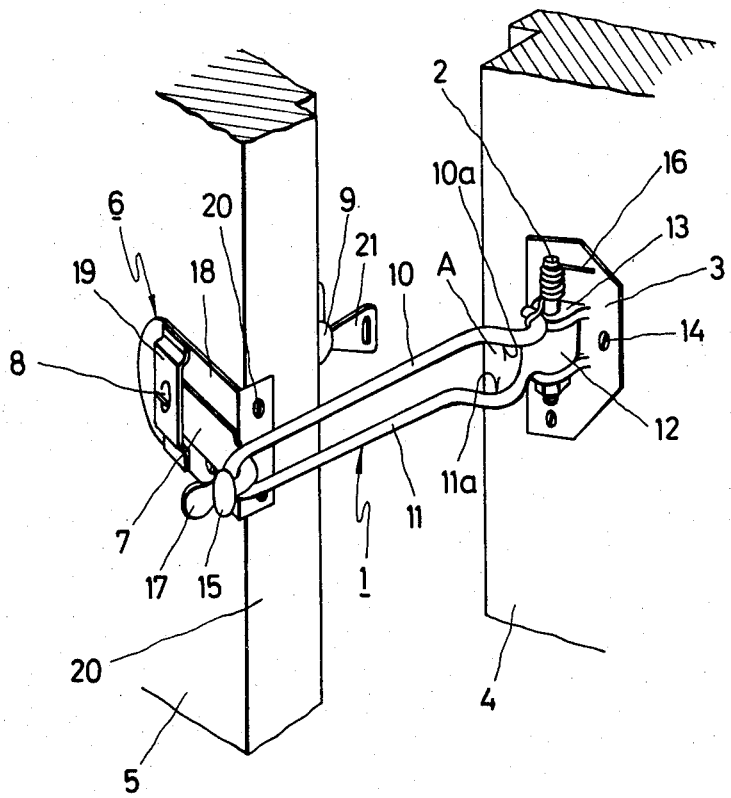
FIG. 1 is a perspective view of a slightly open door retained by a fastening of the invention.
Figure 2:
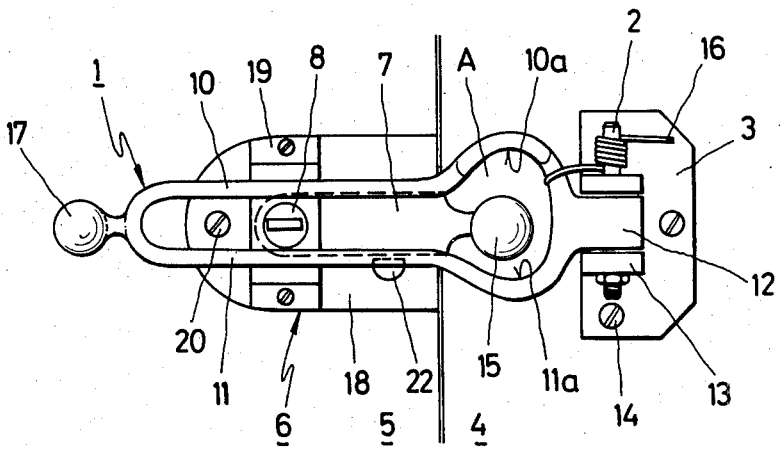
FIG. 2 is a front elevation view showing the closed door position of the fastening of FIG. 1.
Figure 3:
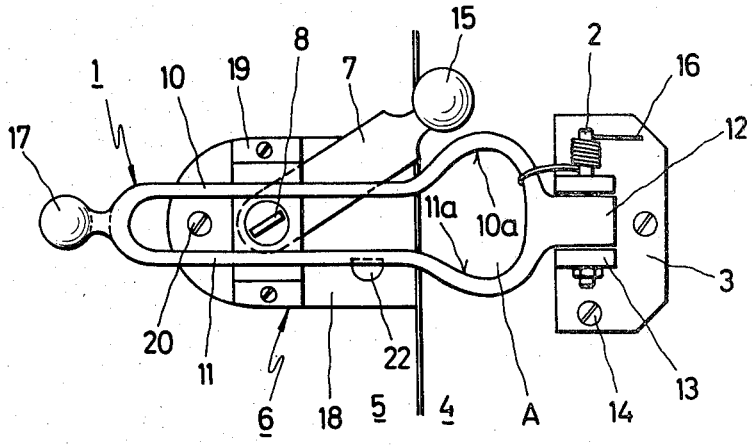
FIG. 3 is a view similar to FIG. 2, showing the position in which the arm, operated from the outside by way of a key, is disengaged from the retaining member, with a view to crossing through the door from the outside.
Figure 4:
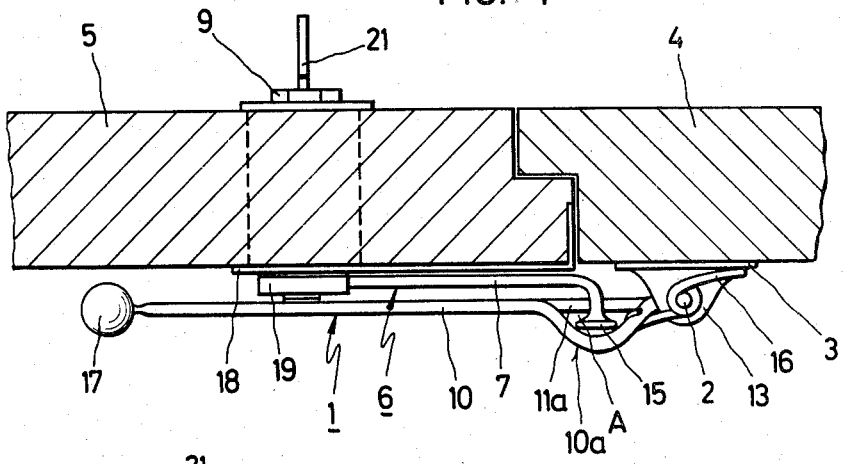
FIG. 4 is a plan view of the fastening in the closed door position of FIG. 2.

The safety fastening of the present invention comprises essentially a retaining member 1 pivotably mounted around a vertical pin 2 supported by a base plate 3 mounted to the door frame 4 of a door 5 and a catch member 6, mounted to the door 5, having an arm 7 fixedly attached to the cylinder 8 of a lock 9 mounted in said door 5.

According to the embodiment illustrated in FIGS. 1 to 4, said retaining member 1 is formed by an elongated loop which, delimiting a longitudinal space, is constituted by two arms 10 and 11 which are parallel over portion of their length and connected at one end to a lug 12 having the vertical pin 2 therethrough, said pin being supported by two lugs 13 of the base plate 3, whereas said plate is attached to the frame 4 by screws 14.

Arms 10 and 11 of the retaining member 1 form, adjacent their inner end curved portions 10*a* and 11*a*, respectively, the former of which is also projected forwardly out of the vertical plane in the opposide side thereof to the door in an extent sufficient to allow the catch member arm to pivot about its axis.

The space between the two curved portions forms a zone A through which the terminal member 15 of the arm 7 may be disengaged from the retaining member by pivoting the latter.

At least one of the arms of the loop is associated with the pin 2 by way of a coil spring 16 biasing the retaining member 1 against the inner face of the door 5 in the closed position of the latter. At their free or outer end, the arms 10 and 11 of said loop meet to form a terminal member 17 for manual holding.

The catch member 6 has the arm 7 mounted between a base plate 18 and a cover plate 19, said base plate being held by screws 20 to the door 5. At the free end of the arm 7 there is formed the said terminal member 15 extending outwardly therefrom generally at rightangles and terminated in the form of a button, for insertion between the parallel portions of arms 10 and 11 of the retaining member 1, and slidable along both without being able to be freed therefrom except at the front face of zone A or through the curved portion 10*a*. A stop pin 22 prevents the arm 7 from pivoting downwardly.

Figure 6:
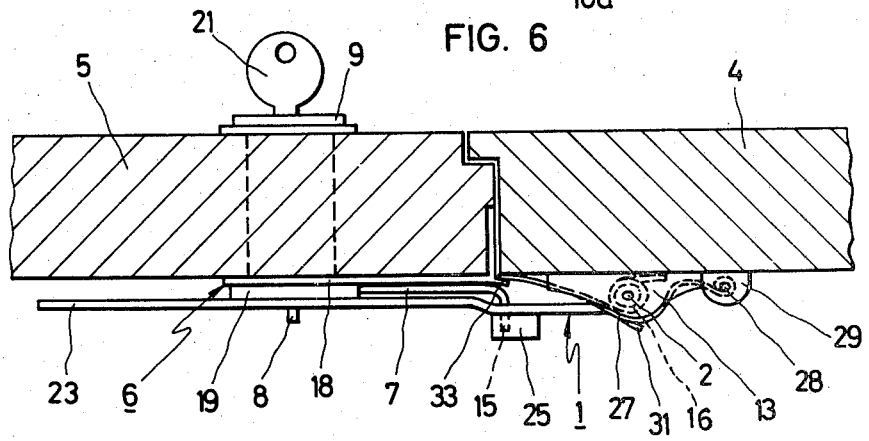
FIGS. 5 and 6 are views similar to FIGS. 2 and 4, of a further embodiment of the safety fastening provided with an automatic means for holding the retaining member in the open position.
Figure 5:
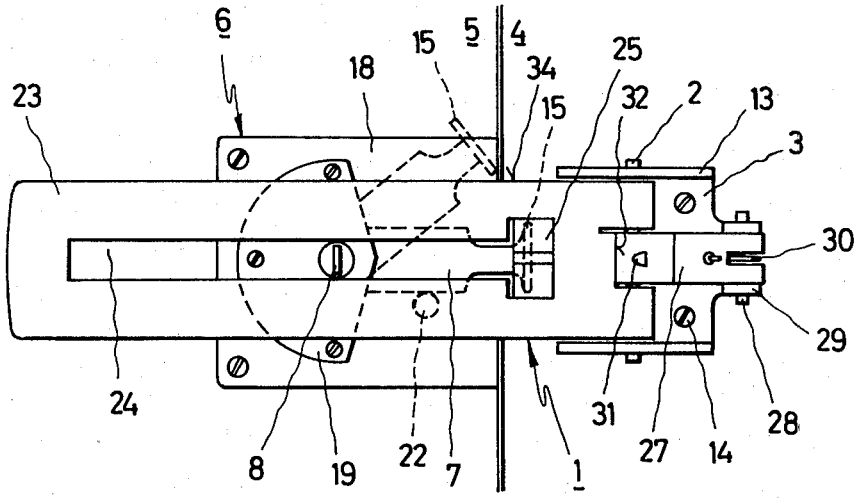
Figure 7:
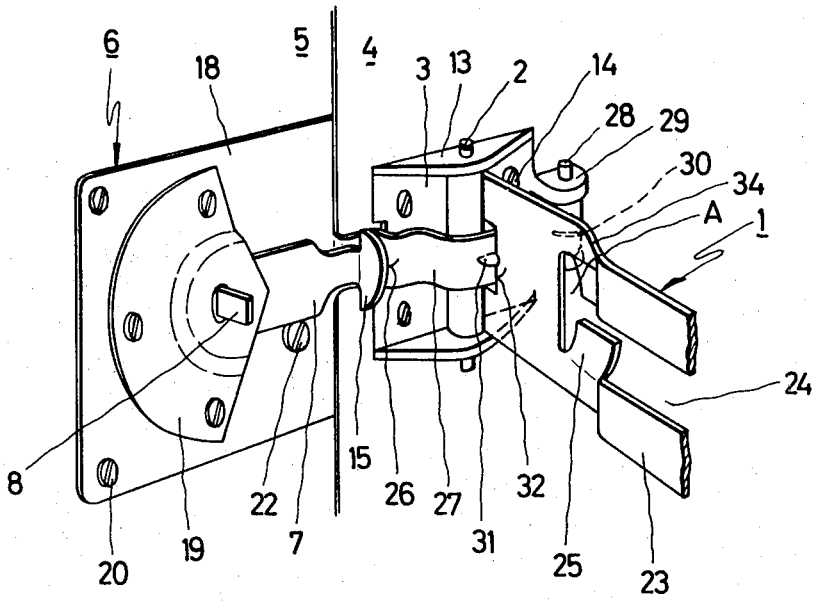
FIG. 7 is a perspective view of the embodiment of FIGS. 5 and 6, showing the retaining member held in the open, inoperative position.

FIGS. 5 to 7 illustrate a further embodiment of the fastening, wherein the retaining member 1 is an elongate flat member 23 having a longitudinal slot or space 24, member 23 being likewise pivotably mounted at a pin 2 and having at the end of the slot 24 adjacent said pin 22 a stamped portion 25 having a curved vertical section extending outwardly in the opposite side thereof to the door. Said stamped portion 25 forms the zone A through which the terminal member 15 may be disengaged from the retaining member by pivoting the latter.

The terminal member 15 of the arm 7 of the catch member also has an external edge 26 curved to match the curve of the stamped portion 25.

On the other hand, means may be fitted to allow the retaining member 1 to be held in the open position thereof. Said means comprises a lever 27 capable of a limited pivoting movement around a pin 28 mounted in lugs 29 of the plate 3, and a spring 30 biasing it away from the frame 4, said lever 27 having a tooth 31 which, in the open position of the retaining member 1, automatically retains it in said position, with said tooth 31 engaging the edge of a cut away portion 32 of the retaining member, wherethrough said lever passes through said retaining member. Also the door 5 or the support plate 18 is provided with an extension 33 which, on the door being closed engages the free end of the lever 27, pivoting of which is limited by the edge of the cut away portion 32, so that in all cases the free end of the lever lies within the field of action of the extension 33.

The fastening operates as follows: in any position, the spring 16 biases the retaining member 1 against the inner face of the door, with the catch member 6 intercalated therein.

If it is desired to open the door from the inside to go out, the retaining member 1 is withdrawn by hand, pivoting it against the spring 16, whereby the door may be freely moved, since the terminal member 15 of the catch member 6 is disengaged through the zone A of the retaining member.

On the other hand, if it is wished to open the door from the inside in response to a call, the door handle is operated and the safety fastening immediately comes in to operation so that the arm 7, in the horizontal position, moves in the retaining member 1 until it reaches the end of the longitudinal space, whereby the opening angle is restricted and there is no way of increasing it, except by reclosing the door. In the said restricted opening position, the door 5 is partially open just sufficiently for the persons on either side of the door to be able to see each other and converse and even to hand over certain small objects.

In the case of opening the door from the outside, the lock 9 must be operated by the key 21, whereby the arm 7 pivots and is disengaged from the retaining member 1 and, in the embodiment of FIGS. 1–4, the arm 7 must be retained in this position and any other lock of the door must be operated to open the door, whereas in the embodiment of FIGS. 5 to 7, once the arm 7 is out of the zone A, it is retained in this position by resting on the edge 34 of the retaining member, as shown in the dotted line in FIG. 5.

In the embodiment of FIGS. 1 to 4, when the door 5 has been freely opened, the retaining member 1 returns on its own to the closed position, requiring it to be reopened by hand to be able to close the door. The said retaining member 1 automatic holding means, illustrated in FIGS. 5 to 7, mean that when the door 5 is opened, the retaining member 1 rotates until the edge of its cut-away portion 32 is engaged by the tooth 31 of the lever 27, whilst when the door is thereafter closed, the extension 33 on the door 5 or on the support plate pushes the lever 27 against its biasing spring 30, whereby the retaining member 1 is freed and is biased once again against the inner surface of the door.

What I claim is:

1. A safety door fastening of the type for limiting the angle of opening of a door and comprising on the one hand a rigid retaining member defining a longitudinal space and being pivotably attached to a vertical pin located on the door frame and on the other hand a catch member mounted to the door, comprising an arm having a terminal member adapted to slide in the longitudinal space of the retaining member and hold it, characterized in that the arm of the catch member is adapted for pivoting around a horizontal axis by operation of a lock means operable from the outside of the door, the retaining means having resilient means biasing it against the inner face of the door when the door is in the closed position thereof and said retaining member also having means which, in the closed position of the door, allow the arm of the catch member to be pivoted until its terminal member is disengaged from the longitudinal space of the retaining member, and further characterized in that the catch member arm is fixedly attached to the cylinder of a lock, said cylinder constituting the pivot shaft of the arm.

2. The door fastening of claim 1, characterised in that the catch member has a stop member limiting the pivoting movement of the arm thereof in a downward direction.

3. The door fastening of claim 1, in which the retaining member delimits a longitudinal space by way of an elongate loop, constituted by two arms connected at their base and parallel one with the other over a portion of their length, connected at their free ends and forming at their base end curved portions determining a greater separation between their arms and in which the terminal member of the catch member arm is of greater dimension than the distance between the parallel portions of said arms but lesser than the distance between the curved portions thereof, characterised in that the retaining member means which, in the closed position of the door, allows for pivoting of the catch member arm until its terminal member is disengaged from the longitudinal space of the retaining member, consists of the curved portion of the upper arm being shaped to project from the plane of said arms in the opposite side thereof to the door.

4. The door fastening of claim 1, in which the retaining member consists of a flat member having a longitudinal slot or space and which is pivotably mounted to a vertical pin located on the door, characterised in that the retaining member means which in the closed position of the door allows for pivoting of the catch member arm until its terminal member is disengaged from the longitudinal slot or space, consists of a stamped portion having a curved vertical section and projecting outwardly from the plane of the flat member in the opposite side thereof to the door and located at the end of the slot adjacent the vertical pin, the terminal member of the catch member arm having an externally curved edge, with a curvature similar to that of the stamped portion, all so that when the arm is caused to move by the lock means, the terminal member of said catch member arm is disengaged from the retaining member by sliding of the terminal member curved edge over the curved inner surface of the stamped portion.

5. The door fastening of claim 4, in which means is provided which, when the door is open, allows the retaining member to be held in its open position, characterised in that said means consists of a cut-away portion in the retaining member and a lever adapted for limited pivoting movement about a vertical pin mounted to the door frame, the lever being biased by a spring away from said frame and said lever being provided with a tooth which in the open position of the retaining member is adapted for engagement with said cut-away portion, whereby the retaining member is held in said open position, the door being provided with an extension means which, on the door being closed, is adapted to engage the free end of the lever and cause it to pivot towards the door frame, whereby said tooth is disengaged from said retaining member cut-away portion, said retaining member being biased by its corresponding resilient means to return against the inner face of the door.

6. The door fastening of claim 1, in which the retaining member delimits a longitudinal space by way of an elongate loop, constituted by two arms connected at their base and parallel one with the other over a portion of their length, connected at their free ends and forming at their base end curved portions determining a greater separation between their arms and in which the terminal member of the catch member arm is of greater dimension than the distance between the parallel portions of said arms but lesser than the distance between the curved portions thereof, characterised in that the retaining member means which, in the closed position of the door, allows for pivoting of the catch member arm until its terminal member is disengaged from the longitudinal space of the retaining member, consists of the curved portion of the upper arm being shaped to project from the plane of said arms in the opposite side thereof to the door.

7. The door fastening of claim 1, in which the retaining member consists of a flat member having a longitudinal slot or space and which is pivotably mounted to a vertical pin located on the door, characterised in that the retaining member means which in the closed position of the door allows for pivoting of the catch member arm until its terminal member is disengaged from the longitudinal slot or space, consists of a stamped portion having a curved vertical section and projecting outwardly from the plane of the flat member in the opposite side thereof to the door and located at the end of the slot adjacent the vertical pin, the terminal member of the catch member arm having an externally curved edge, with a curvature similar to that of the stamped portion, all so that when the arm is caused to move by the lock means, the terminal member of said catch member arm is disengaged from the retaining member by sliding of the terminal member curved edge over the curved inner surface of the stamped portion.

* * * * *